US007448582B2

(12) United States Patent
Jackson

(10) Patent No.: US 7,448,582 B2
(45) Date of Patent: Nov. 11, 2008

(54) APPARATUS FOR DISPLAYING MORE THAN ONE OBJECT

(76) Inventor: Jeffrey Jackson, 2825 Louisville Rd, Suite H, Savannah, GA (US) 31415

( * ) Notice: Subject to any disclaimer, the term of this patent is extended or adjusted under 35 U.S.C. 154(b) by 42 days.

(21) Appl. No.: 11/121,390

(22) Filed: May 4, 2005

(65) Prior Publication Data

US 2005/0236537 A1 Oct. 27, 2005

Related U.S. Application Data

(63) Continuation-in-part of application No. 10/816,097, filed on Apr. 1, 2004, which is a continuation-in-part of application No. 10/346,153, filed on Jan. 16, 2003, now Pat. No. 6,848,660.

(51) Int. Cl.
*A47B 96/06* (2006.01)
*A47H 1/10* (2006.01)

(52) U.S. Cl. ..... 248/215; 248/301; 248/322

(58) Field of Classification Search ..... 248/304, 248/303, 322, 339, 311.2, 309.1, 205.3, 215, 248/231.8; 211/13.1, 117, 118
See application file for complete search history.

(56) References Cited

U.S. PATENT DOCUMENTS

| | | | | |
|---|---|---|---|---|
| 514,222 | A | 2/1894 | Hall | |
| 1,496,388 | A | 6/1924 | Stern | |
| 1,501,807 | A | 7/1924 | Petschel | 211/30 |
| 1,566,982 | A | 12/1925 | Shee | 248/214 |
| 1,726,316 | A | 8/1929 | Saxton | 248/215 |
| 1,943,261 | A | 1/1934 | Knutson | 24/73 |
| 2,080,990 | A | 5/1937 | Weekley | 248/215 |
| 2,461,071 | A | 2/1949 | Mettenleiter | 248/227 |
| 2,472,058 | A | 6/1949 | Artley | 211/13.1 |
| 2,565,719 | A | 8/1951 | Church | 248/215 |
| 2,743,023 | A * | 4/1956 | Larson | 211/96 |
| 3,136,515 | A | 6/1964 | Potruch | 248/62 |
| 3,199,820 | A * | 8/1965 | Thompson | 248/222.41 |
| 3,260,489 | A | 7/1966 | Hentzi | 248/215 |
| 4,065,090 | A * | 12/1977 | Mauney | 248/318 |
| D255,774 | S | 7/1980 | Soucy | D8/371 |
| 4,418,496 | A | 12/1983 | Koistinen | 47/41.12 |
| 4,667,910 | A | 5/1987 | Atterby et al. | 248/71 |
| 4,739,582 | A | 4/1988 | Cullinane | 47/41.12 |
| D300,792 | S | 4/1989 | Hutchins | D6/514 |
| 4,880,133 | A | 11/1989 | Cullinane | 220/85 |
| 4,887,785 | A | 12/1989 | Blaich | 248/339 |

(Continued)

*Primary Examiner*—Amy J. Sterling
(74) *Attorney, Agent, or Firm*—Peter A. Nieves, Esq.; Sheehan Phinney Bass & Green P.A.

(57) ABSTRACT

An apparatus capable of supporting more than one article is provided. The apparatus contains a flat panel that extends in a first plane, and a first region connected at a first end of the first region to the flat panel, wherein the first region extends in a second plane, and wherein the first plane is substantially perpendicular to the second plane. An eyelet is connected to a first surface of the first region, the eyelet being enclosed by a top portion of the eyelet, a bottom portion of the eyelet, a front portion of the eyelet, and a back portion of the eyelet. A body portion is connected to a second end of the first region, the body portion extending away from the flat panel. The apparatus also contains a hook portion that is connected to the body portion.

18 Claims, 6 Drawing Sheets

U.S. PATENT DOCUMENTS

| | | | | | |
|---|---|---|---|---|---|
| 4,979,712 | A | | 12/1990 | Rios | 248/215 |
| D321,795 | S | * | 11/1991 | Winston | D6/328 |
| 5,073,993 | A | * | 12/1991 | Dewaal | 4/227.1 |
| 5,141,192 | A | * | 8/1992 | Adams | 248/231.81 |
| 5,323,993 | A | | 6/1994 | Questel et al. | 248/205.3 |
| D353,790 | S | | 12/1994 | Emalfarb et al. | D11/155 |
| D360,572 | S | * | 7/1995 | Adams | D8/367 |
| 5,487,517 | A | | 1/1996 | Smith | 248/215 |
| 5,516,581 | A | | 5/1996 | Kreckel et al. | 428/317.3 |
| D374,602 | S | | 10/1996 | Protz, Jr. | D8/367 |
| 5,613,656 | A | | 3/1997 | Protz, Jr. | 248/74.2 |
| 6,001,471 | A | | 12/1999 | Bries et al. | 428/343 |
| 6,231,962 | B1 | | 5/2001 | Bries et al. | 428/317.3 |
| D446,110 | S | | 8/2001 | McDuff et al. | D8/367 |
| D447,936 | S | | 9/2001 | Kacines | D8/394 |
| 6,311,851 | B1 | | 11/2001 | Knudsen, Sr. et al. | 211/13.1 |
| 6,364,260 | B1 | | 4/2002 | Lorincz et al. | 248/215 |
| 6,378,827 | B1 | | 4/2002 | Kacines | 248/231.81 |
| 6,543,737 | B2 | | 4/2003 | Decker et al. | 248/316.1 |
| 6,550,737 | B1 | * | 4/2003 | Sai et al. | 248/311.2 |
| 6,601,809 | B1 | | 8/2003 | Gebrara | 248/229.16 |
| 6,676,093 | B2 | | 1/2004 | Franck et al. | 248/205.3 |
| 6,835,452 | B1 | | 12/2004 | Hamerski | 428/343 |
| 2002/0038844 | A1 | * | 4/2002 | Miller | 248/322 |
| 2002/0121581 | A1 | | 9/2002 | Franck et al. | 248/304 |
| 2003/0222190 | A1 | * | 12/2003 | Masas | 248/322 |
| 2004/0188580 | A1 | | 9/2004 | Ryu et al. | 248/304 |
| 2005/0236537 | A1 | * | 10/2005 | Jackson | 248/205.3 |

* cited by examiner

APPARATUS FOR DISPLAYING MORE THAN ONE OBJECT

CROSS-REFERENCE TO RELATED APPLICATIONS

The present application is a continuation-in-part of U.S. patent application Ser. No. 10/816,097, filed Apr. 1, 2004, and having the title "APPARATUS FOR DISPLAYING ORNAMENTAL OBJECTS," which is a continuation-in-part of U.S. patent application Ser. No. 10/346,153 filed Jan. 16, 2003 now U.S. Pat. No. 6,848,660, issued Feb. 1, 2005, the entire disclosures of which are incorporated herein by reference.

FIELD OF THE INVENTION

The present invention generally relates to an apparatus for displaying articles. More specifically, the invention is related to an apparatus for hanging articles from a substrate such as, but not limited to, a ceiling or a wall.

BACKGROUND OF THE INVENTION

Many devices are available for hanging or suspending an article from a wall, a ceiling, or the like. Typically, these devices are mounted on a target surface using thread-based hardware or an adhesive-based arrangement, where the devices permit hanging of an article via use of a hook. The hook may be in many shapes such as an ornate curved hook, a J- or L-shaped hook, a slightly curved segment of a U-shaped hook, or a hook formed by a substantially straight shaft attached at an angle to a base of the shaft.

FIG. 1 is a schematic diagram illustrating a known clip 100 available for hanging or supporting an article from a wall or a ceiling. As is shown by FIG. 1, the clip 100 contains a flat panel 110 that is attached to a first region 115 of the clip 100, where the flat panel 110 extends perpendicular to the first region 115. The flat panel 110 may be attached to another surface, such as a wall or a ceiling, via use of an adhesive or hardware. The clip 100 has a body portion 130, which has a hook portion 160 as an extension of the body portion 130, forming a support zone 150. An end 140 of the hook portion 160 is located opposite the body portion 130. An article to be hung or supported by the clip 100 would rest in the support zone 150.

Unfortunately, if there is a need to suspend a second article via use of the clip, one does not have an elegant solution. Choices available may include using a twist tie or an adhesive tape to attach the second article to the body of the clip, or simply hanging the second article as well in the hook portion. When a twist tie, an adhesive tape, or the like is used, it is tedious both when applying and removing. An adhesive tape may mar the surface of the clip on removal either by damaging the surface or by leaving deposits of adhesive material on the hook. In addition, the second article may stick to the adhesive material, thereby damaging the second article upon removal from the adhesive material.

If a second article is hung in the hook portion, along with the first article, the second article may appear less presentable and not meet the expectations of the user of the clip.

Thus, a heretofore unaddressed need exists in the marketplace to address the aforementioned deficiencies and inadequacies.

SUMMARY OF THE INVENTION

Embodiments of the present invention provide a clip for supporting more than one object. Briefly described, in architecture, one embodiment of the clip, among others, can be implemented as follows. The clip contains a flat panel which extends in a first plane, and a first region connected at a first end of the first region to the flat panel, wherein the first region extends in a second plane, and wherein the first plane is substantially perpendicular to the second plane. An eyelet is connected to a first surface of the first region, the eyelet being enclosed by a top portion of the eyelet, a bottom portion of the eyelet, a front portion of the eyelet, and a back portion of the eyelet. A body portion is connected to a second end of the first region, the body portion extending away from the flat panel. The apparatus also contains a hook portion that is connected to the body portion.

Other apparatus and advantages of the present invention will be, or become, apparent to one with skill in the art upon examination of the following drawings and detailed description. It is intended that all such additional apparatus and advantages be included within this description, be within the scope of this invention, and be protected by the accompanying claims.

BRIEF DESCRIPTION OF THE DRAWINGS

The present invention will be more fully understood from the detailed description given below and from the accompanying drawing of the embodiments of the invention, which however, should not be taken to limit the invention to the specific embodiments enumerated, but are for explanation and for better understanding only. Furthermore, the drawings are not necessarily to scale, emphasis instead being placed upon clearly illustrating the principles of the invention. Finally, like reference numerals in the figures designate corresponding parts throughout the several drawings.

DETAILED DESCRIPTION

The present invention is an apparatus, namely a clip, to support or suspend articles therefrom in a releasable manner. The clip may support many types of articles, such as garland and a bow. It should be noted, however, that the clip might support other articles not mentioned herein. Though the clip can be attached to any surface or a substrate, with adhesive or hardware, the clip, in accordance with the first and second exemplary embodiments of the invention, is described herein for use where the clip is attached to a ceiling.

Figure 1:
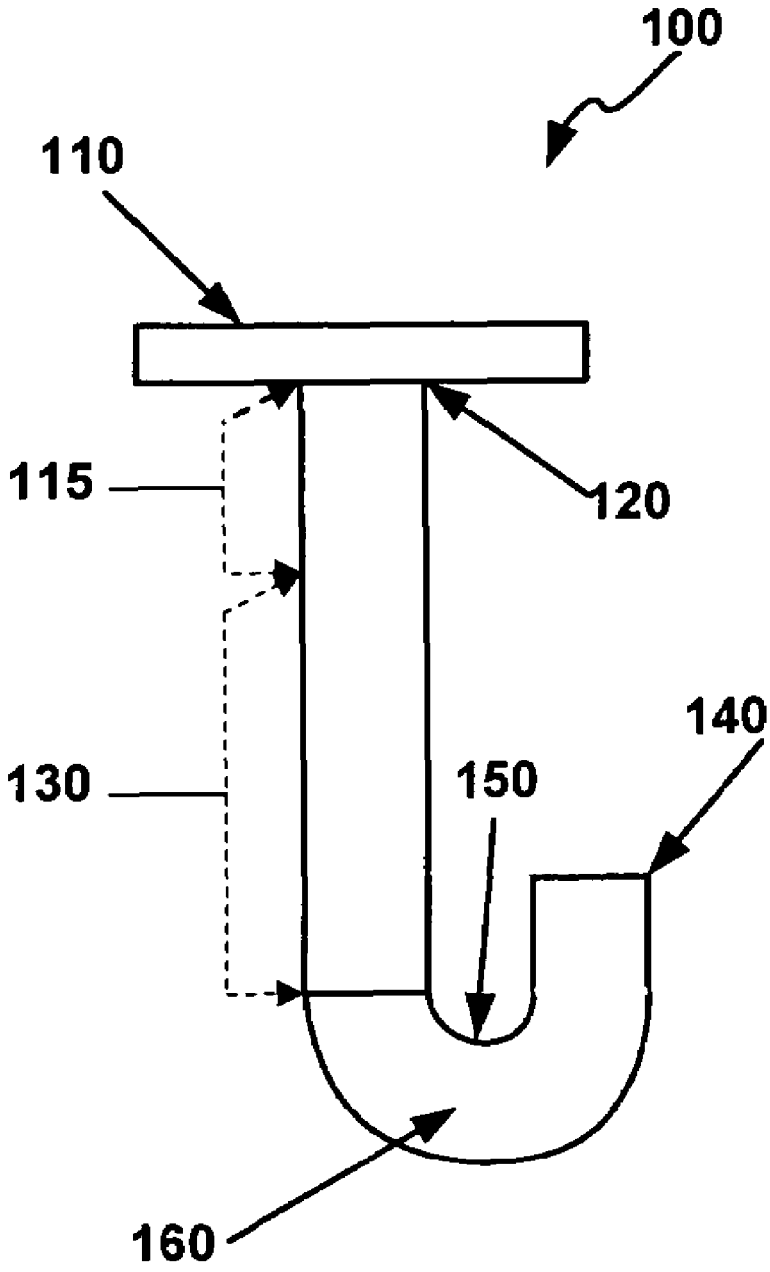
FIG. 1 (PRIOR ART)
FIG. 1 is a side view of a clip in accordance with the prior art.
Figure 2:
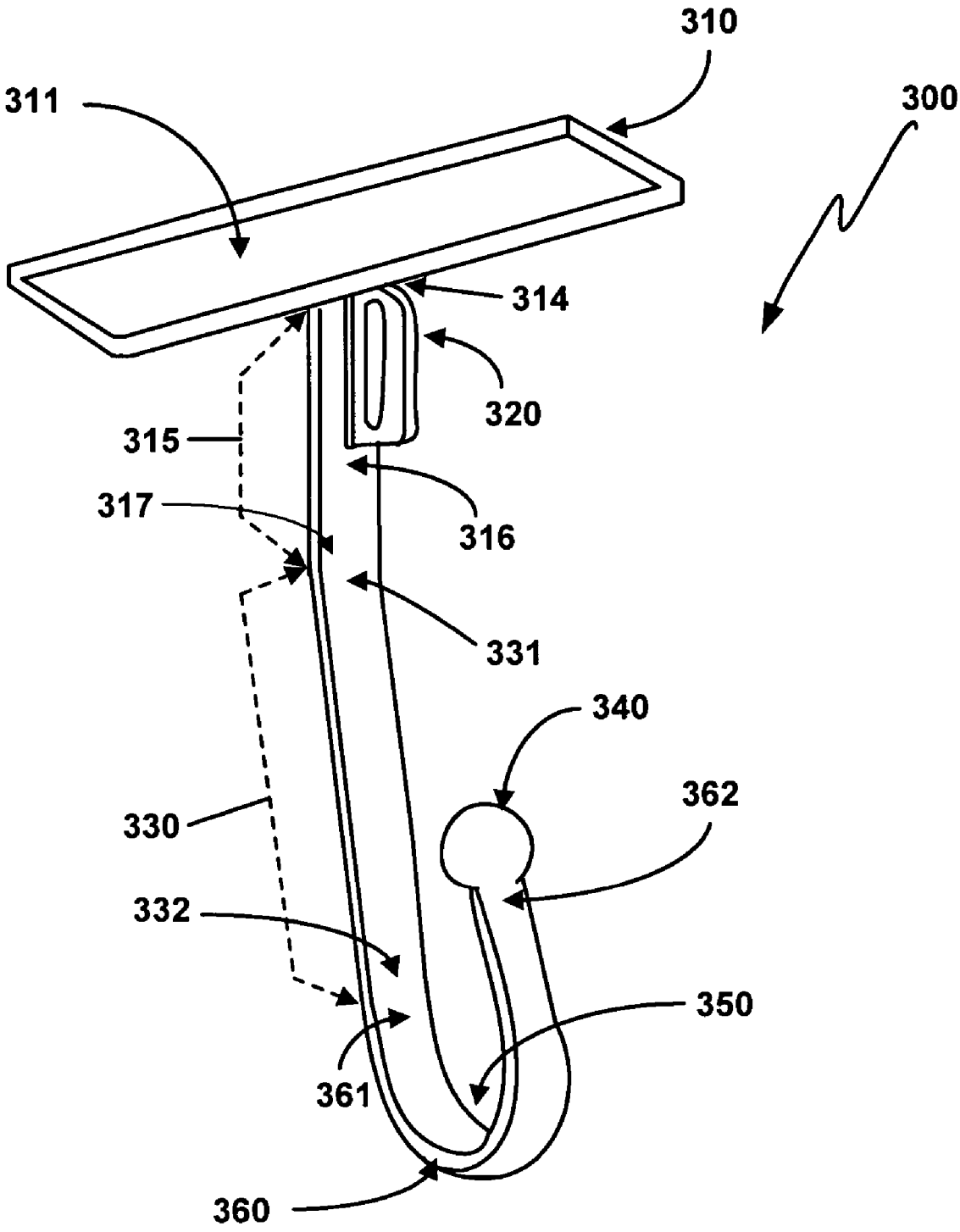
FIG. 2 is a perspective view of a clip, in accordance with a first exemplary embodiment of the invention.
Figure 3:
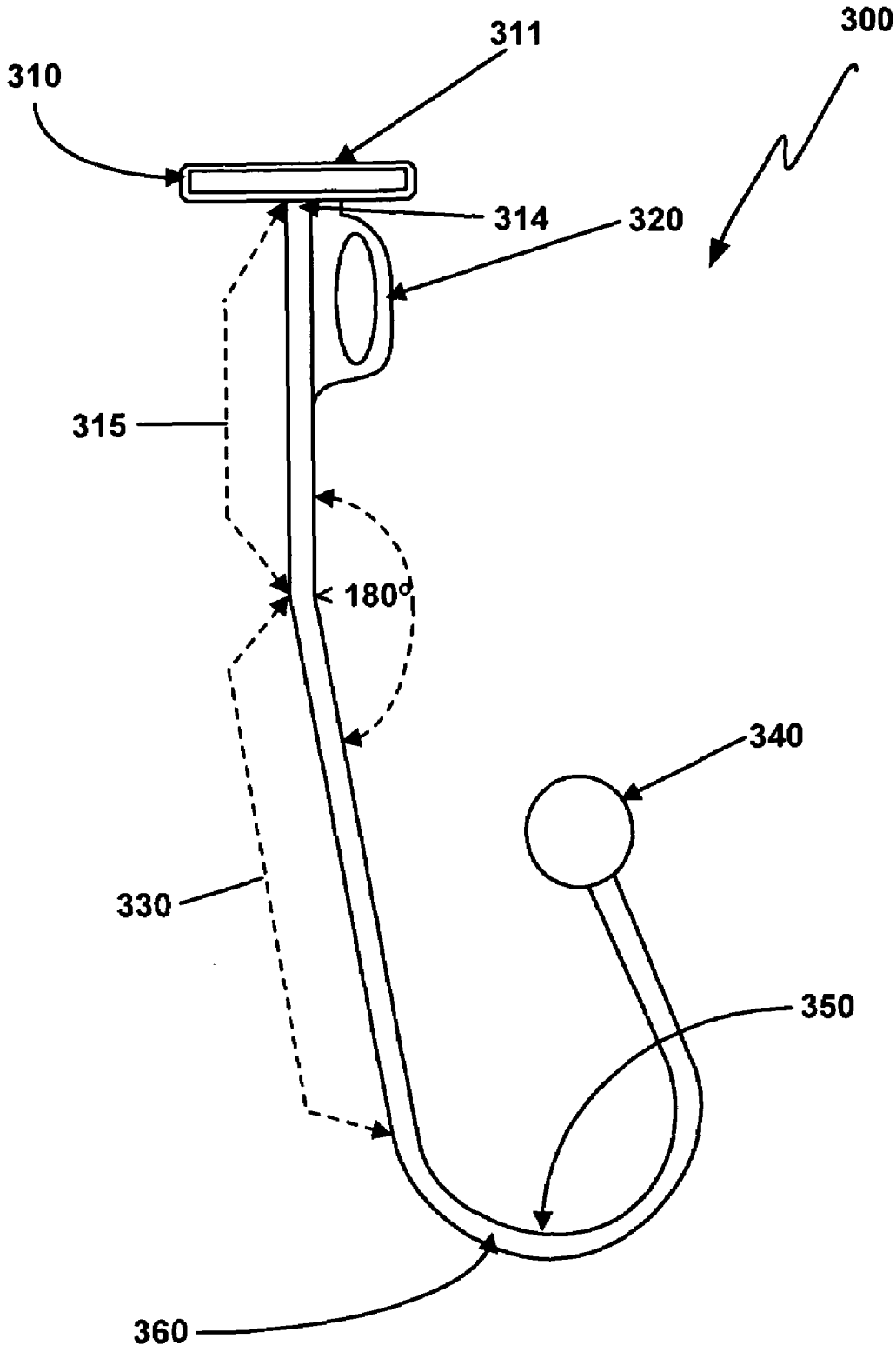
FIG. 3 is a side view of the clip of FIG. 2.

Referring now to the drawings, wherein like reference numerals designate corresponding parts throughout the drawings, FIG. 2 is a perspective view of the clip 300 in accordance with a first exemplary embodiment of the invention. The clip 300 may also be viewed by FIG. 3, which is a side view of the clip 300 of FIG. 2. Referring to FIGS. 2 and 3, the clip 300 has a flat panel 310, a first region 315, an eyelet 320 (i.e., loop portion), a body portion 330, a hook portion 360 defining a support zone 350, and an optional mechanical structure 340. The first region 315 is attached to the flat panel 310 at a first end 314 of the first region 315, a plane of the flat panel 310 being substantially perpendicular to a plane of the first region 315.

The flat panel 310 is capable of being attached to a substrate, such as, but not limited to, a ceiling or a wall, by the use of fastening hardware or an adhesive. As is known to those having ordinary skill in the art, different fastening hardware may be used to attach the flat panel 310 to a substrate. As an example, the flat panel 310 may have holes therein for allowing a screw or nail to extend through the flat panel 310 and into the substrate, where a head of the screw or nail holds to the flat panel 310. Alternatively, if an adhesive is used to allow the flat panel 310 to be attached to a substrate, the adhesive is attached to a top portion 311 of the flat panel 310. It should be noted that the adhesive may be provided in many different forms. As an example, the adhesive may be provided in a liquid form and placed upon the top portion 311 of the flat panel 310. Alternatively, the adhesive may be provided as an adhesive strip having adhesive on both sides of the strip where one side of the strip is attached to the top portion 311 of the flat panel 310.

Size and shape of the flat panel 310 may vary in accordance with use of the clip 300. The flat panel 310 of the present invention is illustrated as being rectangular in shape, however, one having ordinary skill in the art would appreciate that the flat panel 310 may instead be circular, square-like, or any other shape that allows an object being supported by the clip 300 to be supported with the flat panel 310 flush with the substrate to which it is attached.

Figure 6:
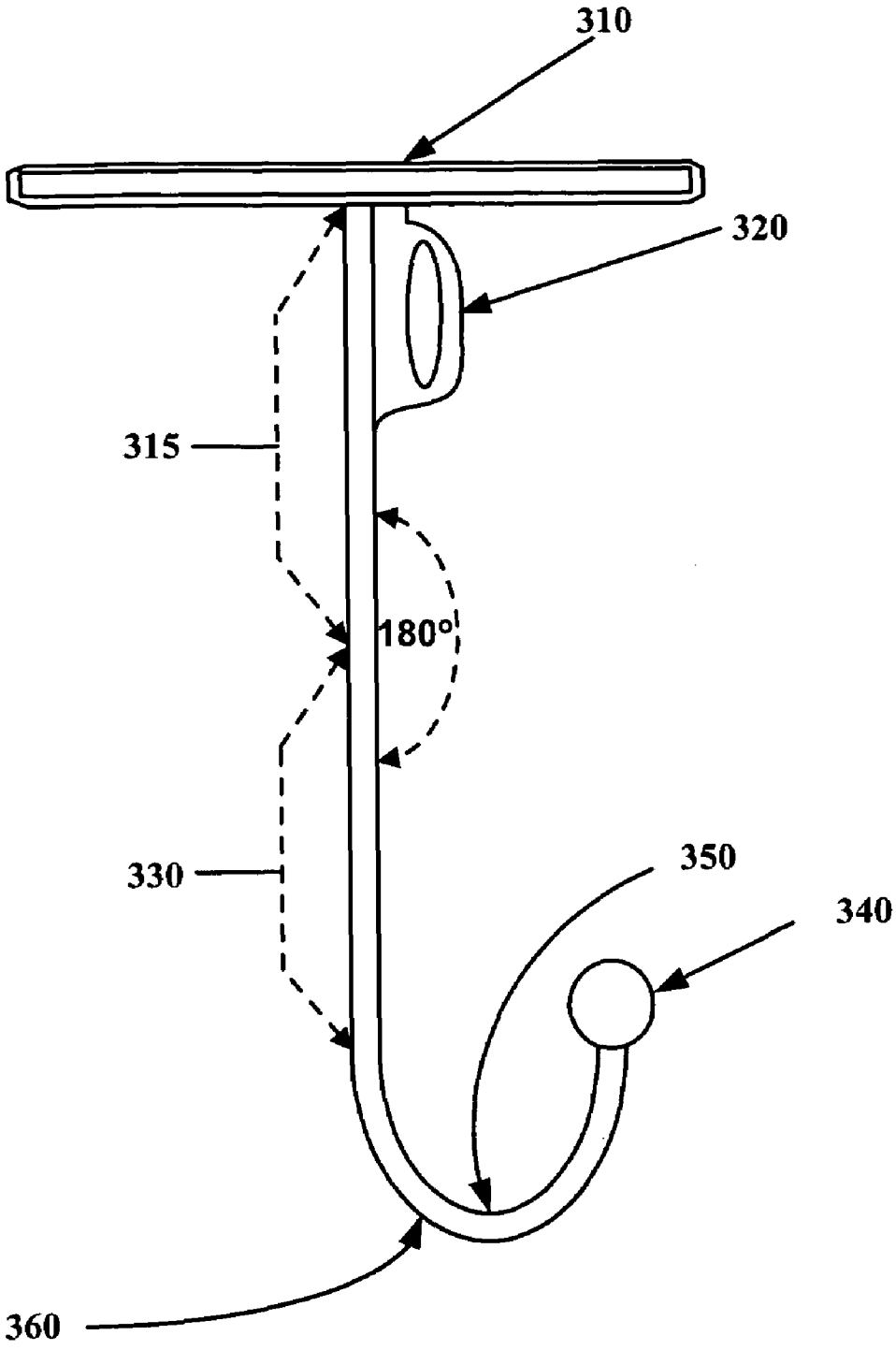
FIG. 6 is a side view of a clip having a flat panel elongated in a direction parallel to a direction at which an eyelet extends from a first region of the clip.

FIG. 2 and FIG. 3 show the flat panel 310 as being elongated in a direction perpendicular to a direction at which the eyelet 320 extends from the first region 315 of the clip 300. Alternatively, as shown by FIG. 6, the flat panel 310 may be elongated in a direction parallel to the direction at which the eyelet 320 extends from the first region 315 of the clip 300.

The first and second exemplary embodiments are more suited for the clip 300 to be attached to a ceiling or the bottom of a widow sill where an article rests within the support zone 350 by gravitational force. In accordance with an alternative embodiment of the invention, the flat panel 310 may be integral with the substrate, thereby not requiring an adhesive or hardware to connect the clip to the substrate.

The first end 315 of the clip 300 may be connected to the flat panel 310 in many different ways. As an example, the clip 300 may be fabricated in a mold, thereby, not requiring the first end 315 to be mechanically connected to the flat panel 310. Alternatively, the first region 315 may be connected to the flat panel 310 by using glue or any other adhesive, or by use of a mechanical connector, such as screws and bolts.

The eyelet 320 is located on a front portion 316 of the first region 315 and located near the first end 314 of the first region 315. Of course, the eyelet 320 could be located further from the first end 314 of the first region 315, or on the body portion 330. The eyelet 320 extends outward from the front portion 316 of the first region 315, in a plane substantially perpendicular to the plane of the first region 315. The eyelet 320 is sized to allow objects to run therethrough. As an example, a bow may be run through the eyelet 320. The eyelet 320 may be sized so as to allow larger or smaller objects to fit therein, or to run therethrough. It should be noted that the eyelet 320 may also be sized to allow objects to be held therein. It should also be noted that the eyelet 320 is enclosed by a top, bottom, front, and back portion of the eyelet 320, with access to the eyelet 320 being provided from a left and right open portion of the eyelet 320.

It should be noted that the eyelet 320 may alternatively be located on the flat panel 310 portion of the clip 300. In such an embodiment, the eyelet 320 would extend away from the flat panel 310 and toward the hook portion 360.

The eyelet 320 permits substantial flexibility in that an additional article may be supported, compared to having just the support zone 350 for support. The eyelet 320 may be attached to the hook 300 in many ways. Some examples are: the eyelet 320 may be attached to the first region 315, the eyelet 320 may be attached to the flat surface 310, and the eyelet 320 may be attached both to the flat surface 310 and the first region 315. Moreover, the eyelet 320 may be formed at an angle between the flat surface 310 and the body portion 330.

The body portion 330 of the clip 300 is an extension of the first region 315, where a first portion 331 of the body portion 330 extends from a second portion 317 of the first region 315, and where the second portion 317 of the first region 315 is located at an end opposite the first end 314 of the first region 315. Length of the body portion 330 is determined by the use of the clip 300 and desired spacing between a first object situated within the eyelet 320 and a second object situated on the hook portion 360. In addition, thickness of the body portion 330 may be determined by the weight of the second object situated on the hook portion 360. As an example, if the second object situated on the hook portion 360 is heavy, it may be desirable to make the body portion 330 thicker so as to be capable of supporting the second object without stretching or breaking. Of course, thickness of the body portion 330 may also depend on the type of material from which the body portion 330 is fabricated, since a stronger material would not necessitate larger thickness for the same strength.

Figure 4:
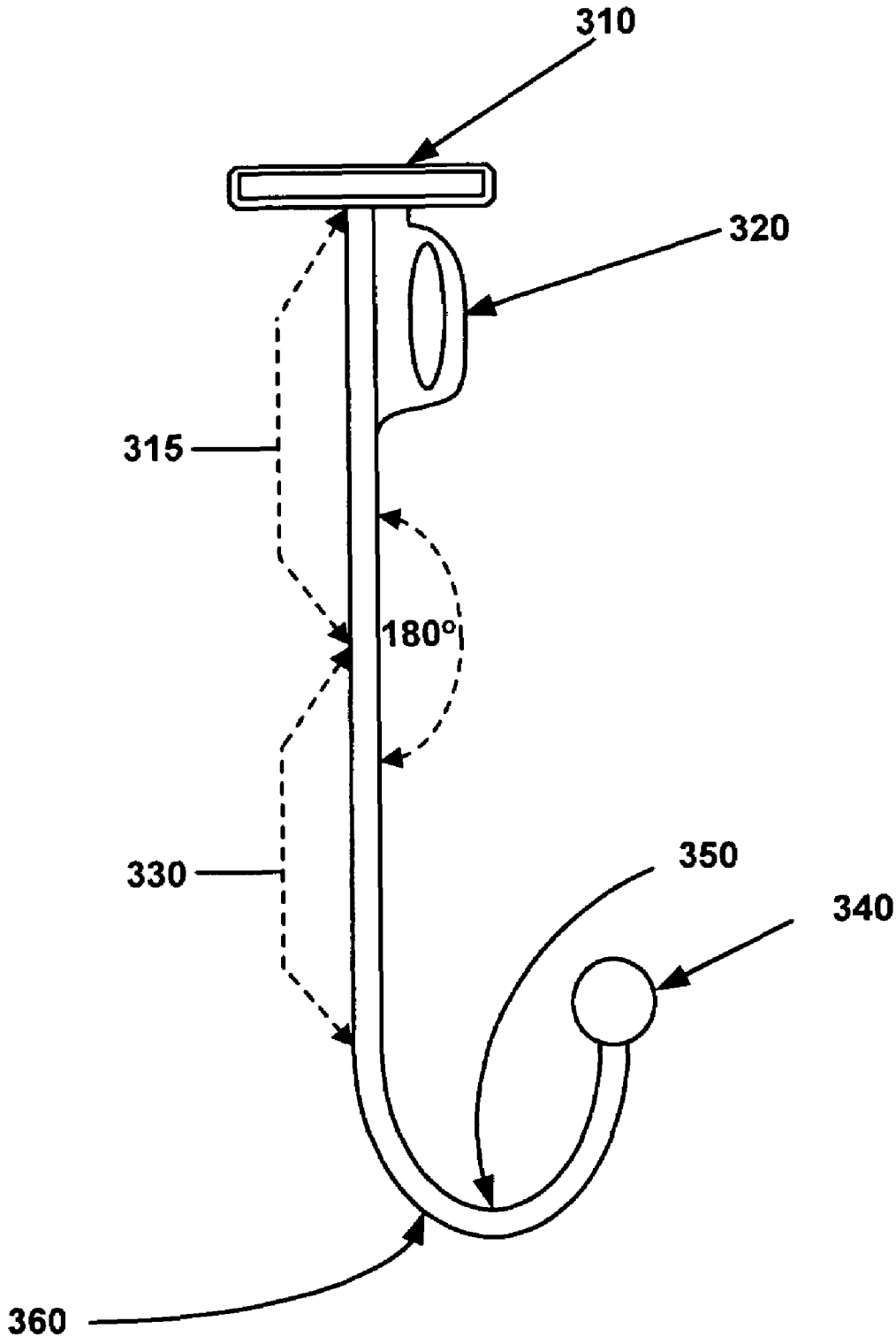
FIG. 4 is a perspective view of the clip of FIG. 2, illustrating an application where the clip is used to support garland and a bow.

In accordance with the first exemplary embodiment of the invention, the body portion 330, while straight, is also slightly angled inward toward the eyelet 320. Therefore, as is shown by FIG. 3, a plane of the body portion 330 meets a plane of the first region 315 at less than 180 degrees. This shape provides for better holding of the second object within the hook portion 360. It should be noted, however, that in accordance with a second exemplary embodiment of the invention, as is illustrated by FIG. 4, the plane of the body portion 330 may meet the plane of the first region 315 at 180 degrees. Alternatively, the plane of the body portion 330 may meet the plane of the first region 315 at more than 180 degrees.

Returning to FIG. 2 and FIG. 3, the hook portion 360 of the clip 300 is curved in shape defining a support zone 350 where the second object may be supported or hung. A first portion 361 of the hook portion 360 is an extension of a second portion 332 of the body portion 330, where the second portion 332 of the body portion 330 extends in a direction opposite the first portion 331 of the body portion 330.

Shape of the hook portion 360 may also differ in accordance with the second object. As an example, if the second object is small the hook portion 360 may be small in size (i.e., the loop of the hook portion being small so as to define a "J" shape). Alternatively, if the second object is large, it may be necessary for the hook portion 360 to be large (i.e., the loop of the hook portion being large so as to define a "U" shape). Specifically, large objects residing on the support zone 350 of the hook portion 360 may require a second portion 362 of the hook portion 360 to extend further toward the flat panel 310, than would small objects.

It should also be noted that the hook portion 360 may be fabricated from the same material as the rest of the clip 300 or from a different material. In addition, in accordance with an alternative embodiment of the invention, the hook portion 360 may be fabricated from a material permitting flexion to let a force change an original shape of the hook portion 360. On removal of the force, the hook portion 360 returns to the original shape of the hook portion 360. Such material may include, but is not limited to, wood, plastic, composite materials, metals, and alloys. Of course, the entire clip 300 may also be fabricated from a material permitting flexion.

The hook portion 360 may end in a mechanical structure 340 that is capable of hindering the second object from coming off the hook portion 360. It should be noted, however, that the mechanical structure 340 is not a necessary component of the clip 300. An example of use of the mechanical structure 340 may be when garland or a string is brought past the mechanical structure 340 and placed on the support zone 350 to hang. The mechanical structure 340 would offer resistance to removal of the garland if the garland is capable of sliding off of the support zone 350, thereby keeping the garland in contact with the hook portion 360. The mechanical structure 340 may be a sphere, a cone, an ellipsoid, or the like, where the dimensions of the mechanical structure 340 are a little wider than the dimension of the hook portion 360. It should be noted that, in accordance with an alternative embodiment of the invention, the hook portion 360 may instead be shaped as an L.

Figure 5:
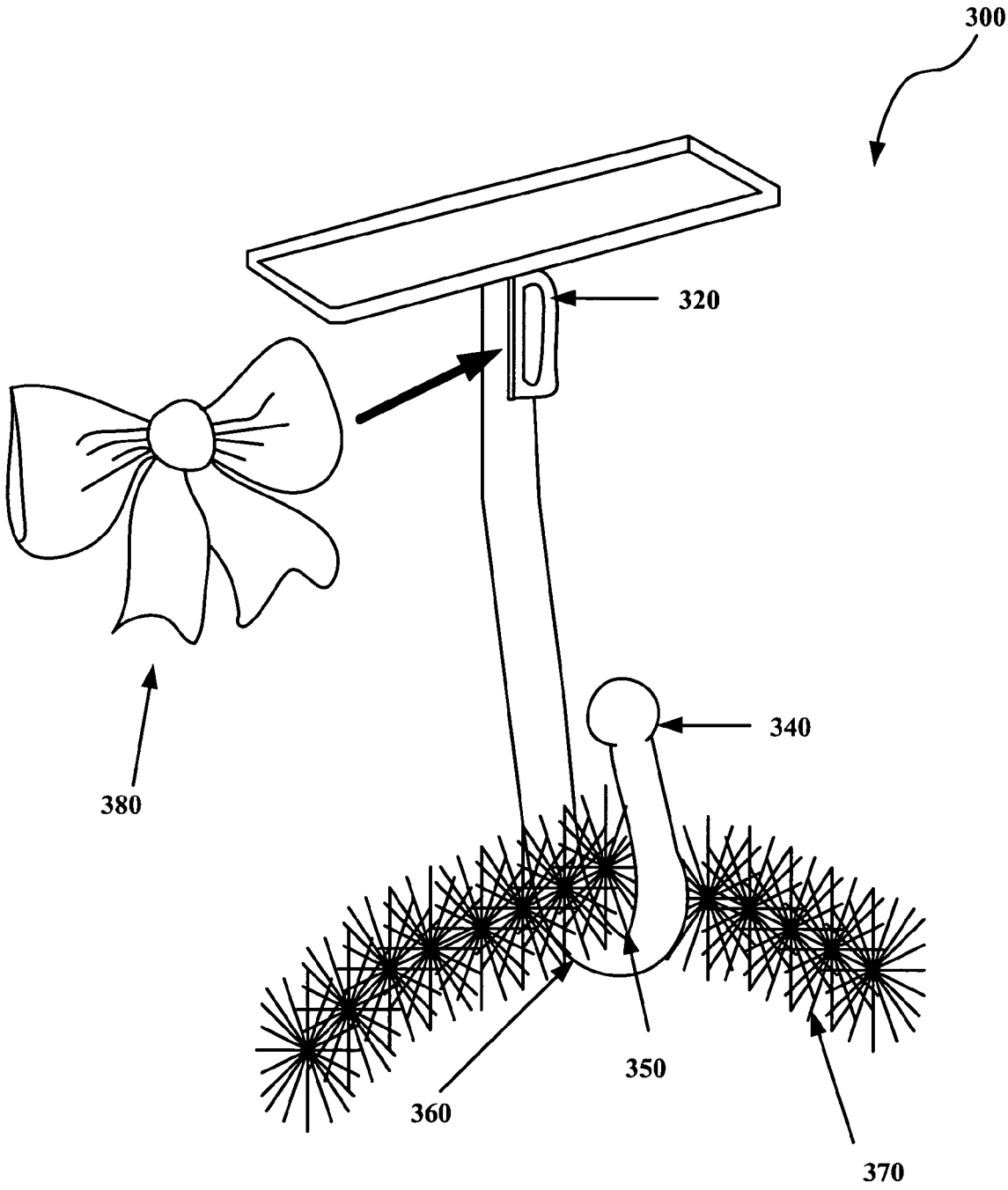
FIG. 5 is a side view of a clip, in accordance with a second exemplary embodiment of the invention.

FIG. 5 is a perspective view of the clip 300 of FIG. 2, illustrating an application where the clip 300 is used to support garland 370 and a string of lights 380. As is shown by FIG. 4, the string of lights 380 is sleeved through the eyelet 320. In addition, the garland 370 is resting on the support zone 350 of the hook portion 360. The mechanical structure 340 is shown for a typical proportion of the size of mechanical structure 340 to the size of the hook portion 360.

It should be emphasized that the above-described embodiments of the present invention are merely examples of implementation, merely set forth for a clear understanding of the principles of the invention. Many variations and modifications can be made to the above-described embodiments of the invention without departing substantially from the spirit and principles of the invention. All such modifications and variations are intended to be included herein within the scope of this disclosure and the present invention. The following claims protect all such modifications and variations.

What is claimed is:

1. An apparatus capable of supporting more than one article, the apparatus comprising:

a flat panel which extends in a first plane comprising means for affixing the apparatus to a planar surface of a substrate;

a first region connected at a first end of the first region to the flat panel, wherein the first region extends in a second plane, and wherein the first plane is substantially perpendicular to the second plane;

an eyelet connected to a first surface of the first region, the eyelet being enclosed by a top portion of the eyelet, a bottom portion of the eyelet, a front portion of the eyelet, and a back portion of the eyelet;

a body portion connected to a second end of the first region, the body portion extending away from the flat panel; and a hook portion, connected to the body portion, wherein the eyelet is also connected to the flat panel.

2. The apparatus of claim 1, further comprising a mechanical structure located at a first end of the hook portion, wherein the first end of the hook portion is located opposite a second end of the hook portion, the second end of the hook portion being connected to the body portion.

3. The apparatus of claim 1, wherein the first region is further defined by a front surface and a back surface, the eyelet extending from the front surface in a direction away from the front surface.

4. The apparatus of claim 3, wherein the flat panel extends in a direction substantially perpendicular to the direction that the eyelet extends from the front surface of the first region.

5. The apparatus of claim 3, wherein the flat panel extends in a direction substantially parallel to the direction that the eyelet extends from the front surface of the first region.

6. The apparatus of claim 1, wherein the body portion extends in a third plane, and wherein the second plane meets the third plane at less than 180 degrees.

7. The apparatus of claim 1, wherein the body portion extends in a third plane, and wherein the second plane meets the third plane at 180 degrees.

8. The apparatus of claim 1, wherein the body portion extends in a third plane, and wherein the second plane meets the third plane at more than 180 degrees.

9. The apparatus of claim 1, wherein the apparatus is fabricated from a material permitting flexion to let a force change an original shape of the apparatus and to let the apparatus return to the original shape of the apparatus when the force is removed.

10. The apparatus of claim 1, wherein a top portion of the flat panel contains an adhesive thereon.

11. The apparatus of claim 1, wherein the flat panel contains holes therein, for allowing a securing device to fit there through.

12. The apparatus of claim 1, wherein the hook portion comprises the shape of a "U."

13. The apparatus of claim 1, wherein the hook portion is in the shape of a "J."

14. The apparatus of claim 1, wherein the hook portion is in the shape of an "L."

15. The apparatus of claim 1 wherein said means for affixing are taken from the group including adhesive and fastening hardware.

16. An apparatus capable of supporting more than one article, the apparatus comprising:

means for affixing the apparatus to a horizontal planar underside surface of a substrate located above the apparatus;

a first region connected at a first end of the means for affixing;

an eyelet connected to a first surface of the first region, the eyelet being enclosed by a top portion of the eyelet, a bottom portion of the eyelet, a front portion of the eyelet, and a back portion of the eyelet, the eyelet being capable of supporting a first article therein;

a body portion connected to a second end of the first region, the body portion extending away from the means for affixing; and means for supporting a second article, wherein the means for supporting the second article is connected to the body portion, wherein the eyelet is also connected to the flat panel.

17. The apparatus of claim 16, wherein the apparatus is fabricated from a material permitting flexion to let a force change an original shape of the apparatus and to let the apparatus return to the original shape of the apparatus when the force is removed.

18. The apparatus of claim 16 wherein said means for affixing are taken from the group including adhesive and fastening hardware.

* * * * *